United States Patent [19]

Rupp

[11] Patent Number: 4,588,075

[45] Date of Patent: May 13, 1986

[54] PORTABLE SOAP HOLDER

[76] Inventor: Robert W. Rupp, 2802 Holiday Pines, Traverse City, Mich. 49684

[21] Appl. No.: 764,664

[22] Filed: Aug. 12, 1985

[51] Int. Cl.[4] ..... A47K 5/08

[52] U.S. Cl. ..... 206/77.1

[58] Field of Search ..... 206/77.1

[56] References Cited

U.S. PATENT DOCUMENTS

| | | | |
|---|---|---|---|
| 553,467 | 1/1896 | Huebel | 206/77.1 |
| 1,554,832 | 9/1925 | Antelmann | 206/77.1 |
| 2,356,056 | 8/1944 | Hogg | 206/77.1 |
| 2,504,536 | 4/1950 | Kisseburg | 206/77.1 |
| 2,886,917 | 5/1959 | Yates | 206/77.1 |
| 3,063,190 | 11/1962 | Adelson | 206/77.1 |

*Primary Examiner*—Joseph Man-Fu Moy

*Attorney, Agent, or Firm*—Douglas S. Bishop

[57] ABSTRACT

An improved portable soap holding apparatus of the type in which a soap holding mechanism is made easily moveable by use of a suction cup as a means of affixing the soap holder to a vertical surface in the area it is to be used. The apparatus includes a primary structure with protruding members to support a bar of soap connected to a suction cup which holds the apparatus in place. The invention was registered under the Disclosure Document Program as Disclosure Document No. 130145.

6 Claims, 3 Drawing Figures

PORTABLE SOAP HOLDER

BACKGROUND OF THE INVENTION

The use of a suction, or vacuum, cup to affix a receptacle or appliance, such as a soap dish, to a vertical, flat surface is generally known. Illustration of this particular embodiment of prior art are U.S. Pat. No. 2,723,485 to Mardre, U.S. Pat. No. 2,717,472 to Wilmington, U.S. Pat. No. 2,309,121 to Keely, U.S. Pat. No. 2,214,869 to West, U.S. Pat. No. 2,131,224 to Kaack, and U.S. Pat. No. 2,044,520 to Weiant. Adaptations of this concept relative to soap holders have included dish or tray type appliances as in the Mardre and Keely patents, listed above, and a device for impaling a bar of soap as in the Wilmington patent, also above listed.

The existing prior art fails to provide a portable soap holding apparatus which allows adequate drying of a bar of soap between usages. Adaptations of the dish or tray type tend to retain soap and water and devices which impale the bar of soap, of necessity, cause deterioration of the bar by the impaling process. Further, the prior art embodiments, be they dish/tray or impaling, require in normal operation that the broadest surface area of the soap bar be horizontal, thus permitting a majority of the surface area of the soap bar to be exposed to and retain standing water. Additionally, devices which provide for a horizontal positioning of the soap bar extend a greater distance from the mounting surface and often tend to interfere with normal use of the area.

Accordingly, a need exists for a portable soap holding device which will utilize a minimum of space in a basin, tub, shower, or other placement, which will minimize standing moisture retention on the bar of soap and which will maximize the amount of surface of the soap bar which is exposed to air for drying purposes.

DISCLOSURE OF THE INVENTION

The present invention satisfies the need hereinbefore by providing an improved, portable soap holding device wherein a bar of soap is supported in an approximately vertical plane, contact between the bar of soap and the device is minimized, the device itself does not have a degenerative effect on the soap bar, and the device itself has minimal protrusion into the room or space where it is located or used.

The device may be mounted on any flat, vertical surface, may be moved as needs dictate or, alternatively, is adaptable to permanent installation if desired.

Accordingly, it is one object of the present invention to provide an improved, portable, soap holding device which will, without impairing the integrity of the soap bar, support a bar of soap in a substantially vertical position which maximizes the outside surface of the soap bar which will be exposed to the air for drying.

Another object of the present invention is to provide a device of the type described, which minimizes intrusion into the working or living space in which the device is placed.

Other objects, advantages and novel features of this invention will be set forth, and will become apparent in the detailed description which follows and with reference to the accompanying drawings, in which.

Figure 1:
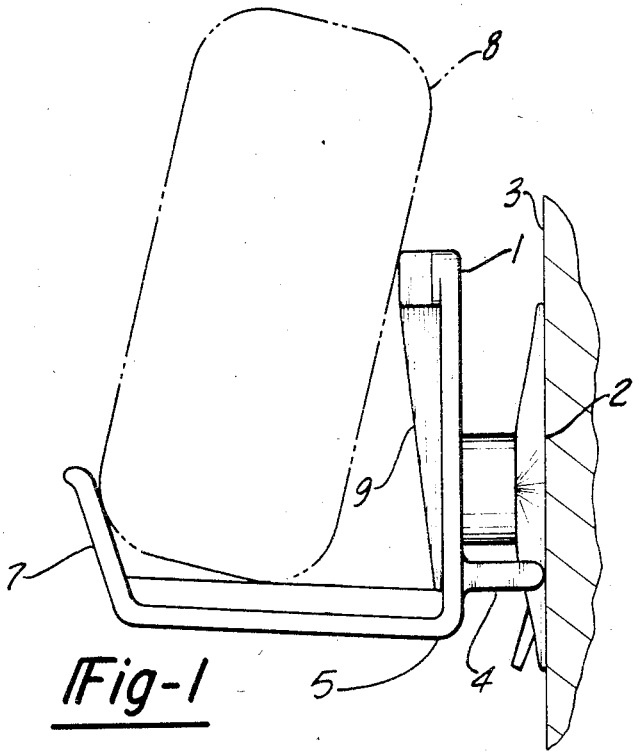
FIG. 1 is a side view of the assembled device showing a bar of soap in place.
Figure 2:
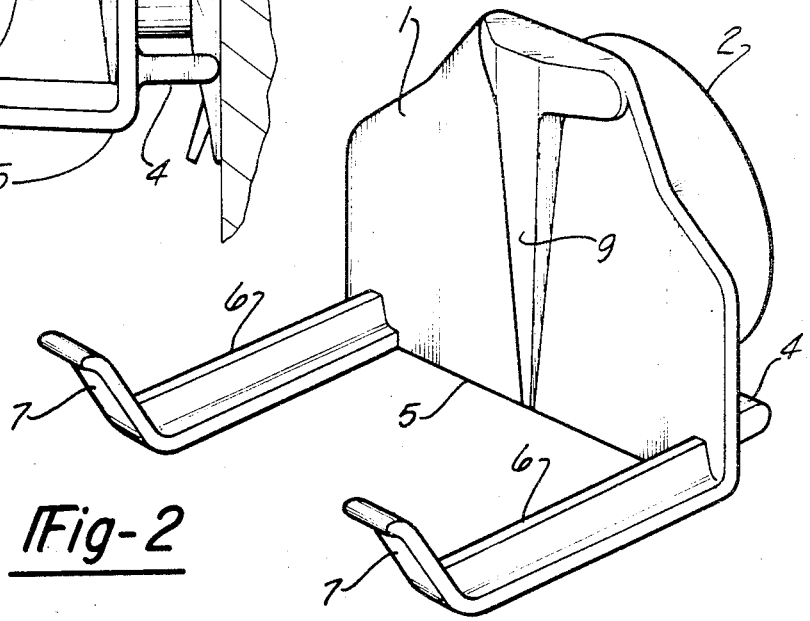
FIG. 2 is a perspective view of the portable soap holder, showing the major components of the invention.
Figure 3:
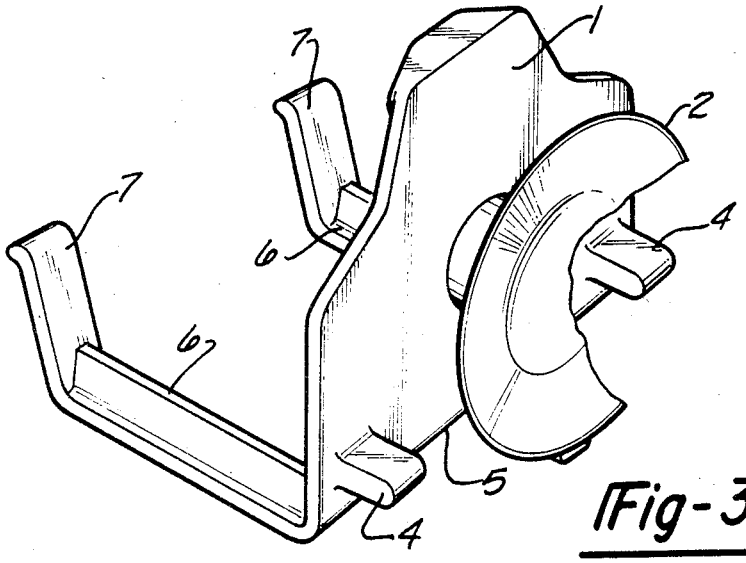
FIG. 3 is a diagonal external view of the assembled device with portions broken away to demonstrate details of construction.

A preferred form of the invention is shown by reference to the drawings in particular.

The improved portable soap holder has a flat, vertically inclined, rear support member 1. Centrally affixed to the rear surface of the support member is a suction cup constructed of rubber, plastic or other material 2 as a means for affixing the invention to any flat vertical mounting surface 3 in the area where it is to be used. For permanent installations other less portable means of affixation may be substituted. Centrally located on the rear support member 2 is a vertical rib 9 which projects progressively outward from the base to the top of the support member 2, to minimize contact between the soap bar 8 and the rear support member 2. Below the suction cup 2 on the rear surface of the support member are two horizonally separated projections 4 which contact the mounting surface when the invention is affixed and holds the invention in a substantially horizontal position. Projecting from the base 5 of the support member are a plurality of horizontal spaced arms 7 mounted substantially below the suction cup 2, each arm having an upwardly inclined flange at its end to retain the soap bar 8 on the arm. The arms cradle the soap bar along a substantially vertical axis for optimum drainage effect and utilize a minimum of space. A particularly useful adaptation provides for the horizontal spaced arms to extend somewhat upwardly so as to rest the soap bar 8 at an angle away from the support member 1 and vertical rib 9.

What is claimed is:

1. A support for a generally rectangular bar of soap adapted to retain the bar with minimum contact on the support and to allow the bar to freely drain, comprising:

(a) a pair of elongated, horizontally aligned arms spaced from one another and extending parallel to one another;

(b) upwardly directed flanges formed on each arm at common ends;

(c) a support rib extending vertically upward, midway between the arms in a plane that extends between the ends of the arms opposite the ends carrying the flanges, the rib having a planar surface, slightly inclined with respect to the vertical, extending upwardly in a direction toward the flanged ends of the arms, and terminating at a height above the upper horizontal surfaces of the arms by a distance greater than half the major dimension of said soap bar, whereby said soap bar may be retained on the support in an attitude slightly inclined to the vertical, with one of its sides in contact with the top of the inclined rib and two points on its lower end in contact with the arms.

2. A support for a bar of soap as set forth in claim 1, wherein the vertical support rib is connected to the horizontal arms by means of a vertically aligned flat plate.

3. A support for a bar of soap as set forth in claim 1, including a means for affixing the support to a vertical surface, said means comprising a suction cup attached to the vertical support, on the side opposite to that which contacts the soap bar.

4. A support for a bar of soap as set forth in claim 1, wherein the upwardly directed flanges terminate substantially below the top of the inclined support rib.

5. A support for a bar of soap as set forth in claim 1, wherein the upwardly directed flanges are outwardly inclined from the inclined support rib.

6. A support for a bar of soap as set forth in claim 1, wherein the entire device is constructed of one-piece, molded plastic.

* * * * *